United States Patent [19]

Sharp

[11] Patent Number: 5,056,680

[45] Date of Patent: Oct. 15, 1991

[54] ATTACHMENT ASSEMBLY FOR SECONDARY CONTAINMENT TANKS

[76] Inventor: Bruce R. Sharp, 22375 Edgewater Dr. Unit 241, Charlotte Harbor, Fla. 33980

[21] Appl. No.: 74,870

[22] Filed: Jul. 17, 1987

[51] Int. Cl.[5] ..... B65D 87/00

[52] U.S. Cl. ..... 220/465; 220/565

[58] Field of Search ..... 220/465, 470, 1 B, 5 A, 220/18, 855, 403, 404, 900, 901, 565

[56] References Cited

U.S. PATENT DOCUMENTS

| | | | |
|---|---|---|---|
| 2,336,885 | 12/1943 | Pepersack | 220/465 X |
| 2,987,216 | 6/1961 | Fletcher | 220/404 X |
| 3,158,459 | 11/1964 | Guilhem | 220/465 X |
| 3,319,430 | 5/1967 | Small | 220/901 X |
| 3,623,629 | 11/1971 | Hendershot | 220/465 X |
| 4,098,425 | 7/1978 | Yamamoto | 220/901 X |
| 4,101,045 | 7/1978 | Roberts et al. | 220/404 |
| 4,408,628 | 10/1983 | Monk | 137/312 |
| 4,552,166 | 11/1985 | Chadbourne, Sr. et al. | 137/15 |
| 4,685,585 | 8/1987 | Robbins | 220/5 A X |

*Primary Examiner*—Steven M. Pollard

*Attorney, Agent, or Firm*—Charles R. Wilson

[57] ABSTRACT

A storage tank with secondary containment with a manway for entry into the interior of the tank has an assembly which is dimensioned to fit within the manway. An annular space between the assembly and manway wall is formed which can be monitored for leakage. When secondary containment is provided by a bladder within a rigid tank, the assembly further comprises a flange at its bottom surface and a ring element dimensioned to mate with the lower flange. Securing means hold the bladder between the lower flange and ring element. Secondary containment of the manway is also provided by the assembly.

13 Claims, 4 Drawing Sheets

ATTACHMENT ASSEMBLY FOR SECONDARY CONTAINMENT TANKS

This invention relates to storage tanks having secondary containment with a manway to gain access to the interior of the tank. More particularly, this invention relates to an assembly for use in a storage tank's manway to provide total secondary containment and permit monitoring of any leakage.

BACKGROUND OF THE INVENTION

Commercial and industrial storage tanks are widely used for storing a great variety of liquids. Some of these liquids are highly corrosive and/or are flammable. The service life of a storage tank will vary, depending upon the environmental conditions, including the liquid being stored. Eventually, however, the tank will become corroded and develope leaks. This can result in a significant danger to the environment and health of nearby residents. For example, storage tanks are commonly used for storing gasoline at service stations. Gasoline, of course, is highly flammable and is capable of posing a significant health and safety hazard if not properly contained. Federal as well as local regulations govern the structure of such storage tanks.

Heightened public awareness of the danger posed by storage tanks (particularly underground storage tanks) has led to additional governmental regulations. Recent proposed regulations will soon require most storage tanks to have secondary containment means and possibly a fail safe design feature to guard against accidental soil, water, and air contamination. Secondary containment means must be capable of containing leaked liquid from the storage tank. Bladders within rigid storage tanks have been suggested as one effective means of attaining secondary containment capability. U.S. Pat. Nos. 4,524,609 and 4,552,166 disclose the use of bladders. Double walled tanks have been suggested as another alternative. U.S. Pat. No. 4,523,454 contains one disclosure of a jacketed tank.

Certain storage tanks are designed with a manway on their top surfaces. The manway typically is two to three feet in diameter and has a manhead cover bolted to its top. The manway allows access to the tank's interior for a worker to enter and do any necessary inspections and repairs. The manway opening is also sometimes used as an opening through which a fill line and dispensing line can pass. This type of tank has posed a problem for the aforementioned designs utilizing a secondary containment feature. Thus, a bladder within a rigid tank having a manhead must somehow account for the large opening. Special attachment means must be used to allow easy initial installation and continued use without imparing containment features. Additionally, true secondary containment must include secondary containment for the manway as well as the main storage tank.

There has been developed assemblies for use with storage tanks having secondary containment capabilities. The assemblies use manways of existing tanks with a minimum of change. True secondary containment of the total storage tanks including its manway is achieved.

SUMMARY OF THE INVENTION

An assembly for attachment to a manway in a storage tank comprises a cylindrical-shaped main body dimensioned to fit within the manway and attachment means. An annular space is provided between the assembly and the manway walls. When used in a storage tank having a bladder for containment purposes, a flange extending from the main body's lower extremity and a ring element for attachment thereto are provided to hold the bladder.

DETAILED DESCRIPTION OF THE INVENTION

The invention is primarily useful with underground storage tanks and this preferred use is described below with reference to the drawings. The invention could, however, be used with above-ground storage tanks and obtain many of the same advantages.

Figure 1:
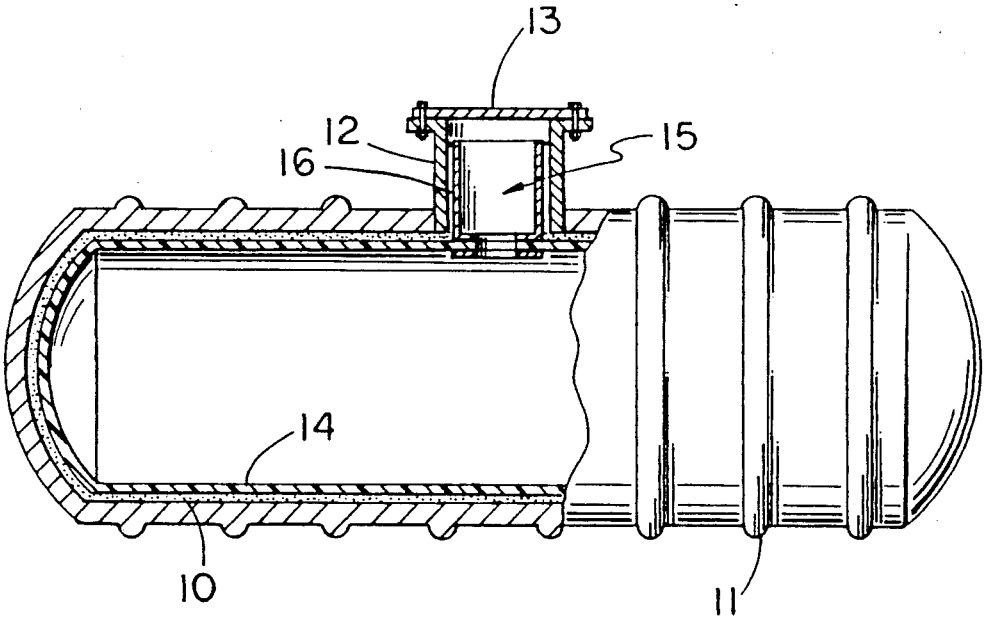
FIG. 1 is a side view of a storage tank with a partial cutaway showing a bladder as primary containment of liquid and an assembly positioned with the tank's manway.

With reference to FIG. 1 there is shown an underground storage tank 11 with a manway 12. The manway is large enough to allow a human to gain entry to the tank's interior for inspection and repair purposes. The manway also may be a means whereby various access lines such as a fill pipe, dispensing line and vent pipe (not shown) enter the tank's interior. Manhead cover 13 seals the tank's contents. A bladder 14 is positioned within the tank to provide primary containment of stored liquid while the rigid storage tank provides secondary containment. A gas previous material 10 is shown to maintain a spaced relationship between the bladder 14 and tank 11 and aid in leak detection. The improvement comprises the assembly shown generally as 15. An annular space 16 between said assembly and the manway is provided.

Figure 2:
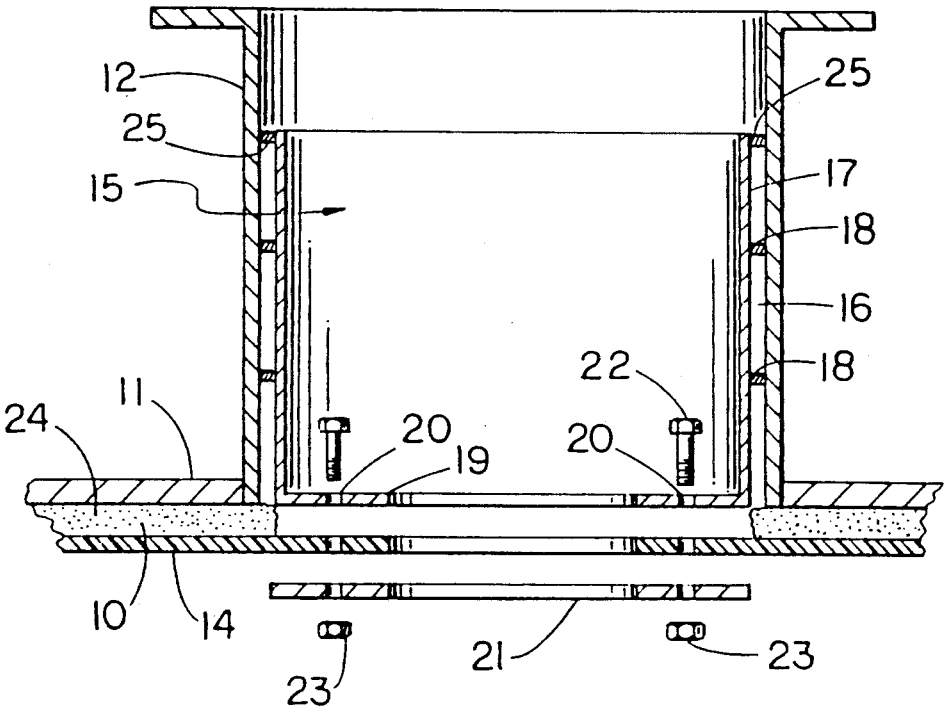
FIG. 2 is an exploded view in section showing the assembly and manway of FIG. 1 in detail.

As best seen in FIG. 2, the assembly has a cylindrical shaped main body 17 which is dimensioned to fit within the manway 12. Attachment means of various known types are used to hold the main body to the manway. As shown, spot attachments 18 hold the assembly securely. Extending inwardly from a bottom extremity is a flange 19 with spaced holes 20.

A ring element 21 dimensioned to mate with the bottom flange 19 of the main body is provided to hold the bladder securely between the ring element and bottom flange. Bolts 22 extending through holes in the ring element and bottom flange with nuts 23 keep the bladder properly sealed when the nuts are tightened. As shown, the bottom flange 19 extends inwardly to allow accessibility to the bolts and nuts. Any number of holes with bolts and nuts spaced around the flange can be used. An opening is provided in the bladder so that access through the manway is not impaired. A closed space 24 between the bladder and inner walls of the storage tank is in communication with the closed space 16 defined by the annular space between the manway and cylindrical-shaped main body. A continuous weld seal attachment, for example, 25 at the top edge of the main body in effect defines the upper limits of the closed space.

Figure 3:
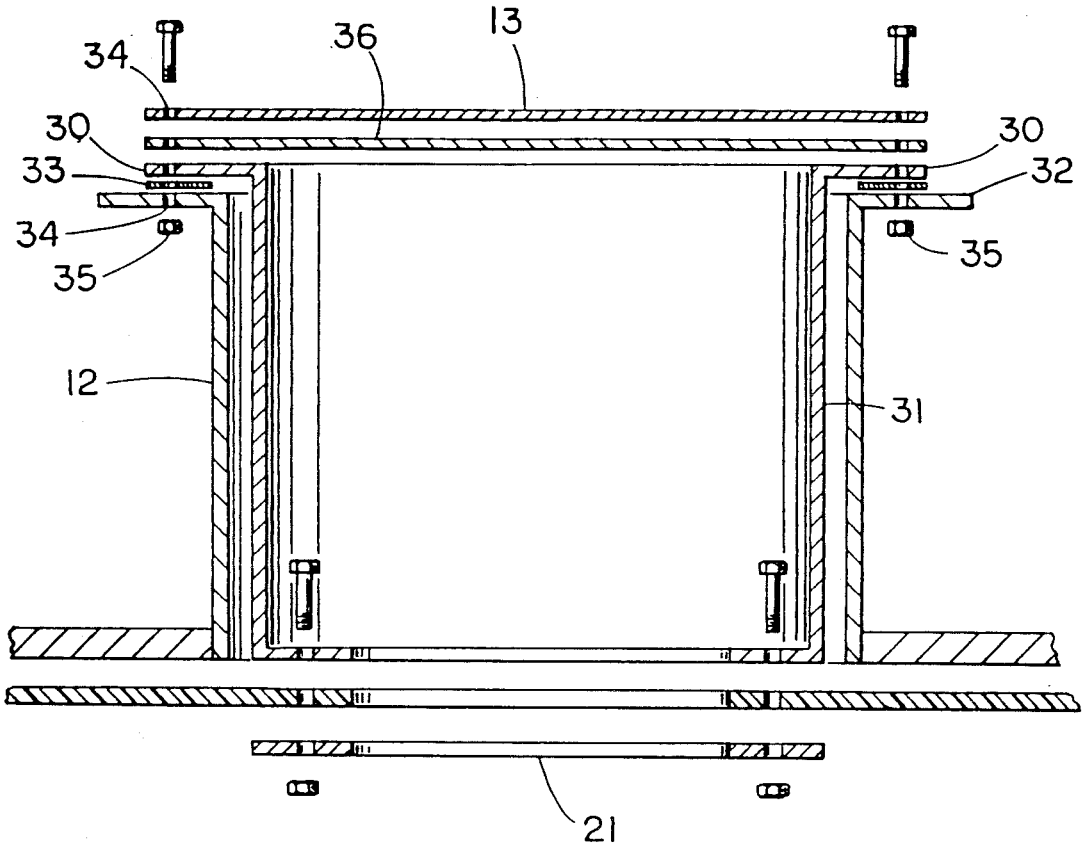
FIG. 3 is a exploded view in section showing another assembly of the invention having an upper flange.

With reference to FIG. 3 there is shown another assembly dimensioned to fit within a manway and provide an annular space between their walls. An upper flange 30 extends outwardly a sufficient distance from the cylindrical-shaped main body 31 to rest upon the manway's top flange 32 and gasket 33. Bolt holes 34 are provided in the assembly's upper flange so that when properly aligned, one set of bolts can be used to attach the manhead cover and the assembly to the manhead. In effect, the assembly is suspended in the manway space. Nuts 35 and a gasket 36 are used to provide a sealed cover. This assembly design provides secondary containment for the storage tank, including the manway walls.

Figure 4:
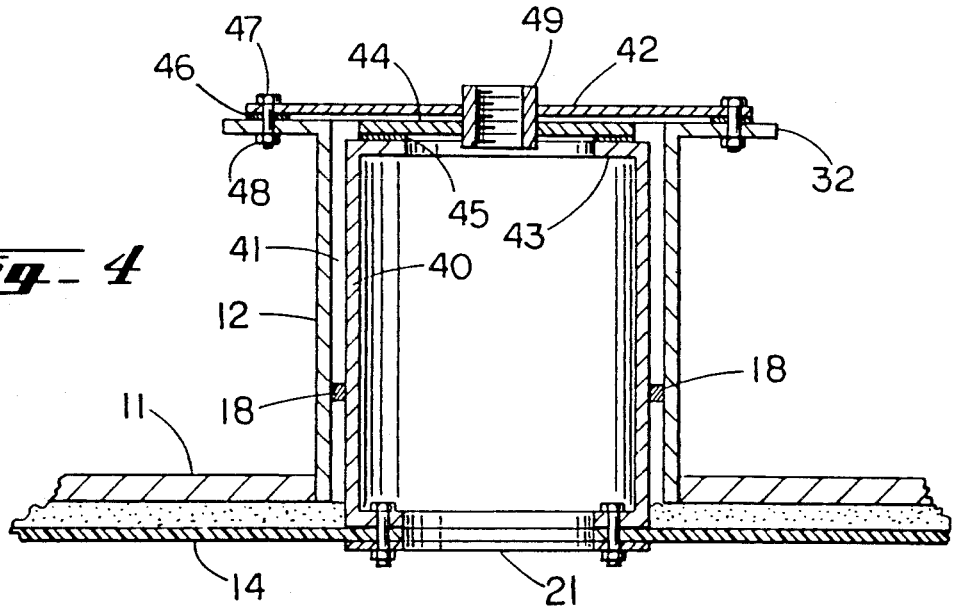
FIG. 4 is a partial view in section showing an assembly of the invention positioned within a manway with a two manhead cover system.
Figure 5:
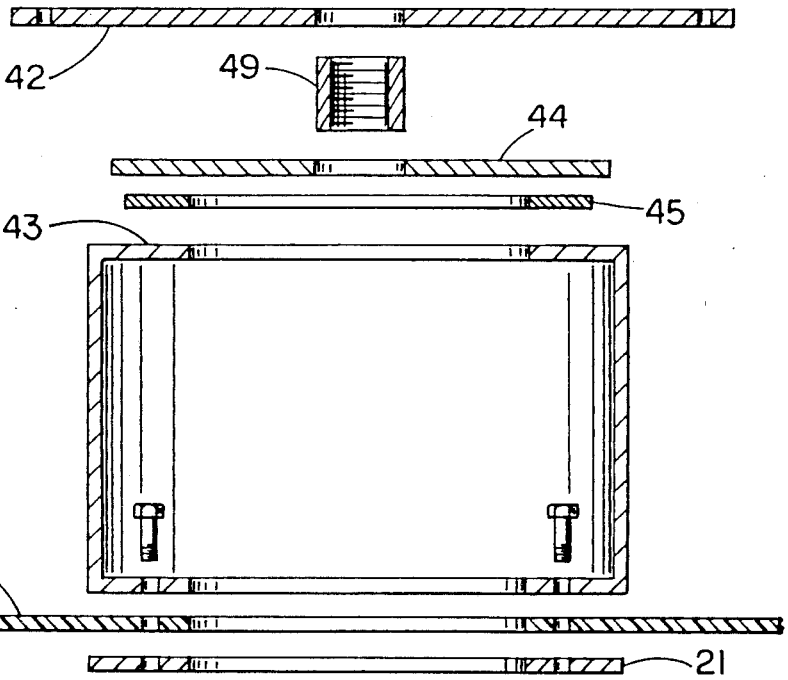
FIG. 5 is an exploded view of the assembly of FIG. 4.

FIGS. 4 and 5 show an assembly having integral covers for the assembly and manway, thereby providing secondary containment for the total storage tank system. The cylindrical-shaped main body 40 is spot attached, for example welded to the manway 12 so that a closed area 41 extends to the secondary manhead cover 42. An upper flange 43 extends inwardly from the main body. A primary manhead cover 44 rests on the upper flange 43 and has a gasket 45 positioned under it to ensure a good seal. The secondary cover 42 with a gasket 46 is provided for resting on the manway's upper flange 32 with bolts 47 and nuts 48 for securing it to the manway. A fitting 49 used to accomodate a fill line or dispensing line is attached by welding means into both primary cover and secondary cover. The fitting 49 when properly spaced forces a good assembly seal and manway seal at gaskets 45 and 46, respectively. The result is one continuous closed space defined by (1) the bladder 14, cylindrical-shaped main body 40 and primary cover 44 and (2) the rigid tank 11, manway 12 and secondary cover 42.

Figure 6:
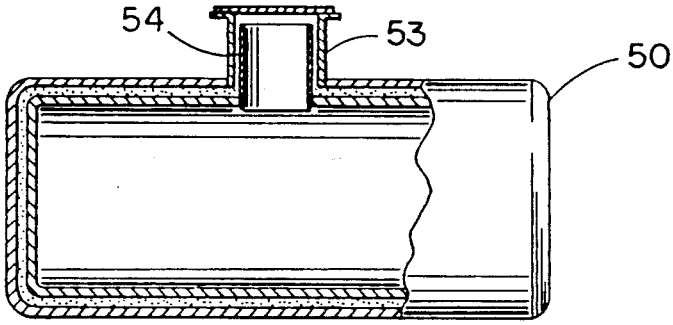
FIG. 6 is a side view of a storage tank with a partial cutaway showing a rigid double wall with an assembly of this invention positioned within the tank's manway.
Figure 7:
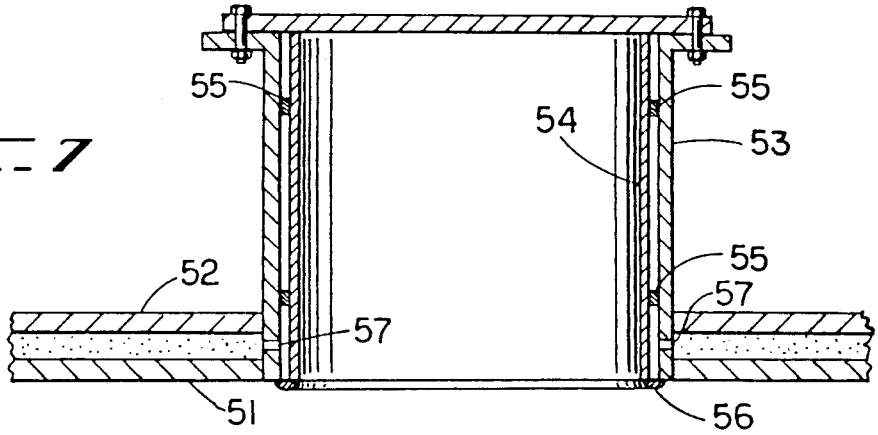
FIG. 7 is a view in detail of the assembly of FIG. 6 in the manway.

Shown in FIGS. 6 and 7 is a partial section of a double walled storage tank 50 having walls 51 and 52, a manway 53, and an assembly of this invention positioned within its manway. As depicted, the cylindrical-shaped main body 54 extends the height of the manway; it could extend only partially the height, though, secondary containment of the full manway would not be achieved. Attachments 55 hold the main body to the manway. A continuous seal 56 at the lower extremity defines the annular space between the main body 54 and manway. At least one hole 57 is preferably provided in the manway so that communication is established with the closed space between the double walls of the storage tank. Preferably, each of the walls is rigid.

Figure 8:
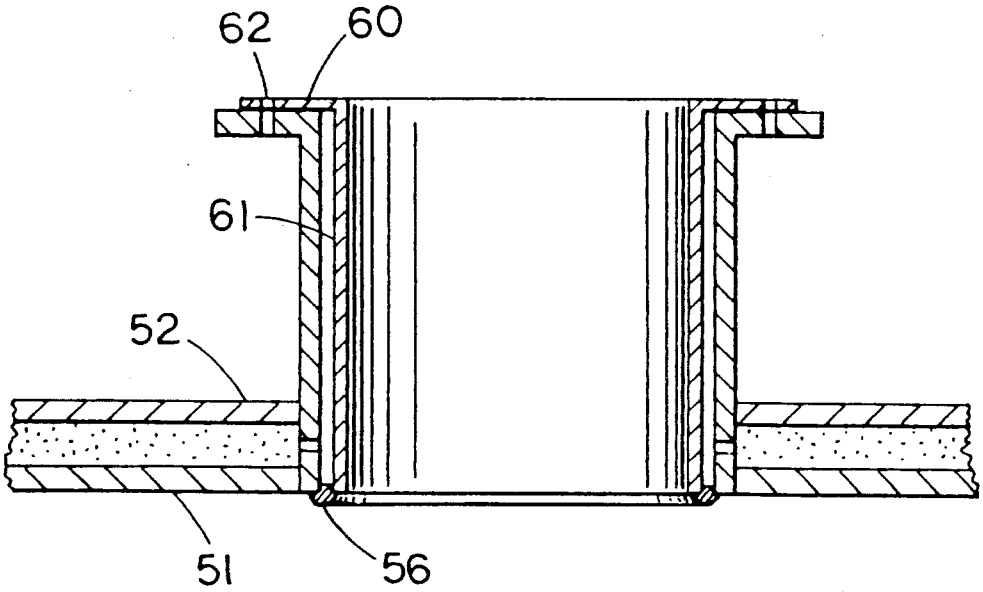
FIG. 8 is a view of another assembly for use with a double wall storage tank.

With reference to FIG. 8, there is shown another assembly for use with the double walled storage tank of FIG. 6. A flange 60 extends outwardly from the assembly's main body 61 so as to rest on the upper flange of the man way. Bolt holes 62 are provided so the the assembly is secured by tightening of the manhead cover to the manway flange. A gasket, not shown, can be provided with the flange.

Figure 9:
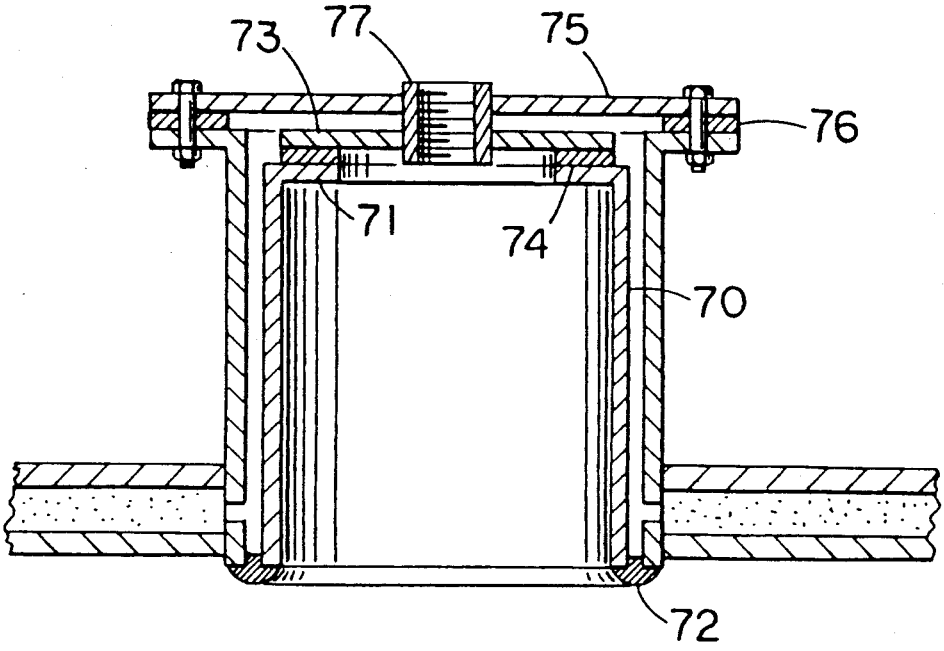
FIG. 9 is still another assembly with provision for a double cover.

FIG. 9 shows another embodiment of the invention for use with a double wall storage tank wherein a double cover assembly is provided. Cylindrical-shaped main body 70 with upper inwardly extending flange 71 is sealed to manway by the cover assembly. Continuous weld 72 seals the annular space defined by the main body, manway and manhead. Primary manhead cover 73, gasket 74, secondary manhead cover 75, gasket 76 and fittings 77 are provided and operate in the sam fashion as the double covers of FIG. 4. In a preferred embodiment, a leak detection system is used to monitor the closed spaces. Several detection systems including pressure sensors, liquid sensors, optic sensors, and electric systems are useful. Reference is made to U.S. Pat. No. 4,607,522 columns 4 and 5, the disclosure of which is hereby incorporated by reference.

The invention herein has been made with reference to the drawings. Various obvious modifications can be made without departing from the scope of the appended claims.

What is claimed is:

1. In a storage tank having secondary containment provided by a bladder within a rigid tank and with a manway for entry into the interior of the tank, wherein the improvement comprises an assembly positioned within the manway, said assembly having:

(a) a cylindrical-shaped main body dimensioned to fit within said manway with an annular space between the manway walls and said main body and to extend substantially to the lowermost portion of the manway, said main body having a lower flange extending from its lower extremity;

(b) attachment means for holding the cylindrical-shaped body to the manway;

(c) a ring element dimensioned to mate with the lower flange extending from the main body so as to hold there between a bladder; and (d) securing means for holding the ring element to the lower flange.

2. The storage tank of claim 1 wherein the lower flange extends inwardly from the main body.

3. The storage tank of claim 1 wherein the attachment means for holding said cylindrical-shaped main body to the manway are spot welds.

4. The storage tank of claim 1 further comprising an upper flange extending inwardly from the main body, a primary manhead cover for covering the interior portion of the assembly and attachment means for holding the cover to the upper flange in a sealed fashion.

5. The storage tank of claim 4 further comprising gasket means positioned between the upper flange and cover.

6. The storage tank of claim 5 further comprising a fitting in the cover, said fitting useful for receiving an access pipeline to the interior of the storage tank.

7. The storage tank of claim 1 wherein the cylindrical-shaped main body extends to substantially the entire height of the manway.

8. In a storage tank having secondary containment provided by a double wall with a manway having a wall for entry into the interior of the tank, wherein the improvement comprises an assembly positioned within the manway, said assembly having:

(a) a cylindrical-shaped main body having a lower outside surface wall and dimensioned to fit within said manway with an annular space between the manway wall and said main body, further wherein said main body has an upper flange extending inwardly therefrom;

(b) attachment means for holding said main body to the manway's interior;

(c) a primary manhead cover for covering the assembly; and (d) attachment means for holding the manhead cover to the upper flange of the main body in a sealed fashion.

9. The storage tank of claim 8 wherein the assembly further comprises gasket means positioned between the upper flange and cover.

10. The storage tank of claim 9 wherein the assembly further comprises a fitting in the cover, said fitting useful for receiving an access pipeline to the interior of the storage tank.

11. The storage tank of claim 8 wherein the assembly further comprises sealing means at the main body's lower outside surface wall to form a confined annular space.

12. The storage tank of claim 8 further wherein both walls of the storage tank are rigid.

13. The storage tank of claim 8 wherein the cylindrical-shaped main body of the assembly extends substantially the entire height of the manway.

* * * * *